United States Patent [19]

Holyoke

[11] Patent Number: 4,941,290

[45] Date of Patent: Jul. 17, 1990

[54] APPARATUS FOR REMOVING PHOTOGRAPHIC IMAGES FROM A FILM MEMBER

[76] Inventor: Robert H. Holyoke, 4001 N. Ocean Blvd., Apt. 301B, Boca Raton, Fla. 33431

[21] Appl. No.: 299,796

[22] Filed: Jan. 23, 1989

[51] Int. Cl.[5] ..... B24B 7/00

[52] U.S. Cl. ..... 51/74 R; 51/78; 51/326

[58] Field of Search ..... 51/74 R, 78, 137, 138, 51/139, 326

[56] References Cited

U.S. PATENT DOCUMENTS

| | | | |
|---|---|---|---|
| 2,115,217 | 4/1938 | Sandorff | 51/78 |
| 3,277,609 | 10/1966 | Horie et al. | 51/78 |
| 3,683,559 | 8/1972 | Kalwaites | 51/74 |
| 4,201,015 | 5/1980 | Reim | 51/74 R |

*Primary Examiner*—Frederick R. Schmidt
*Assistant Examiner*—Maurina Rachuba
*Attorney, Agent, or Firm*—Oltman and Flynn

[57] ABSTRACT

Apparatus for removing photographic images from Mylar film comprising first and second abrading rollers and deformable and resilient pressure rollers which partially overlie the abrading rollers at laterally offset locations so different segments of the film are scraped by the respective abrading rollers. The film is advanced past the abrading rollers by feed rollers and overlying nylon rollers that are spring-biased down against the feed rollers with enough force to prevent slippage between the feed rollers and the film. A motor drives the abrading rollers at a much higher surface speed than that of the feed rollers.

20 Claims, 10 Drawing Sheets

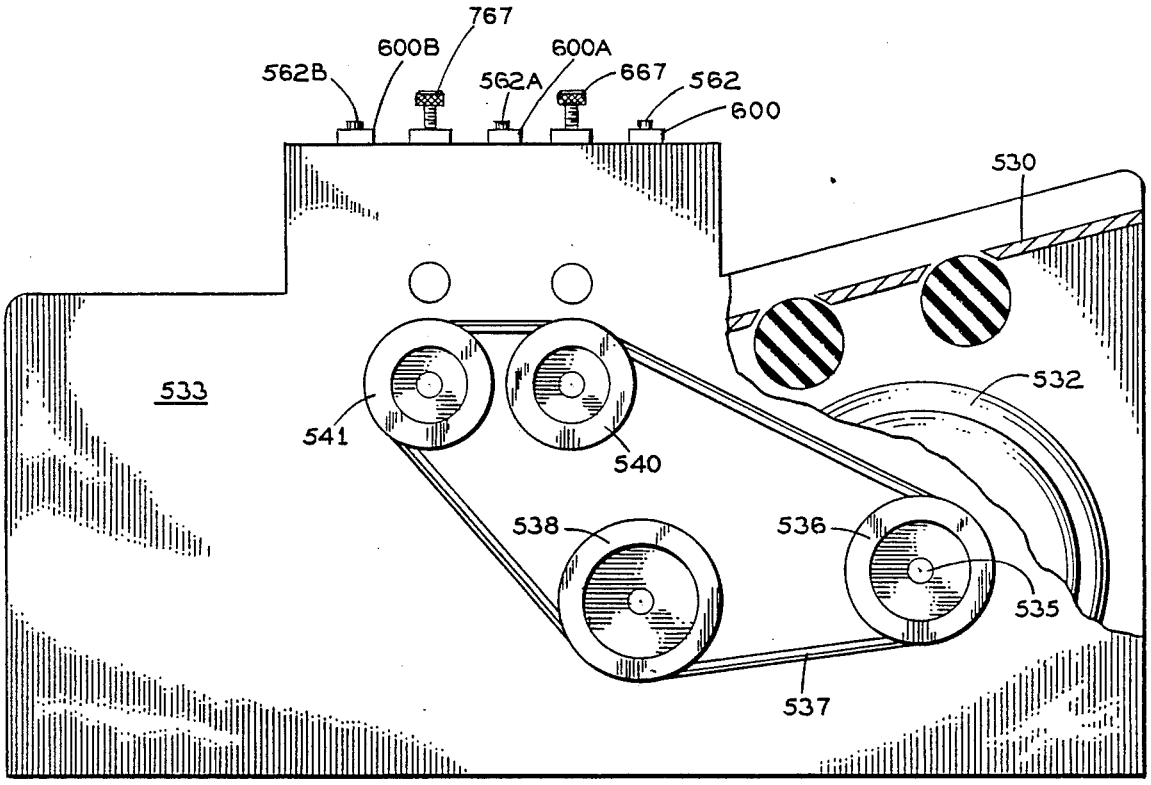
FIG. 12
FIG. 13
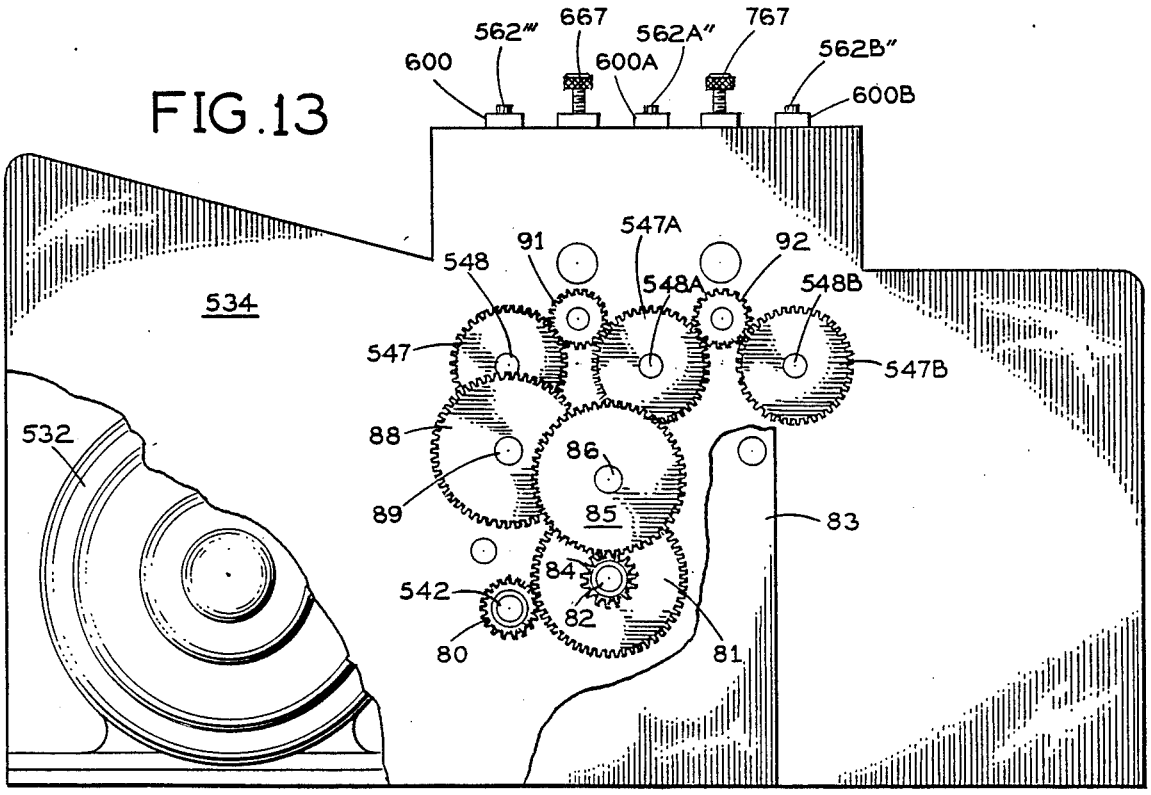

APPARATUS FOR REMOVING PHOTOGRAPHIC IMAGES FROM A FILM MEMBER

This invention relates to an apparatus for removing photographic images from a photographic film member, such as a microfiche or a roll of film.

BACKGROUND OF THE INVENTION

Mylar film, either in microfiche form or in a roll, often is used for photographically recording highly sensitive information. Mylar film is a highly oriented polyester. When the decision is made to destroy this recorded information it is necessary that the destruction be so complete as to eliminita the possibility that an unauthorized person might reconstruct a useful amount of the putatively destroyed information.

SUMMARY OF THE INVENTION

The present invention is directed to a novel apparatus for removing photographic images from a film member, particularly a Mylar microfiche or film roll.

A principal object of this invention is to provide such an apparatus which scrapes the surface of the film member where the photographic images are located, removing minute particles of the film member which carry photographic images recorded on the film member.

Preferably, the present invention comprises:

- feed rollers and pressure rollers for advancing the film member along a predetermined straight-line path without slippage between the feed rollers and the film member;
- a first abrading roller and pressure rollers for scraping off segments of the photographic images at certain location across the width of the film member.
- a second abrading roller and pressure rollers for scraping off the remaining segments of the photographic images at their locations across the width of the film member;
- and a motor drive arrangement for the feed rollers and the abrading rollers which rotates the abrading rollers at a much higher surface speed than the feed rollers, so that the surface speed of each abrading roller is much higher than the speed of the film member moving tangentially past it.

Preferably, also, the pressure rollers that coact with the feed rollers are heavily spring-biased toward the feed rollers to prevent slippage of the film member, and the pressure rollers that coact with the abrading rollers are of relatively soft yieldable material and are lightly spring-biased toward the abrading rollers.

Further objects and advantages of this invention will be apparent from the following detailed description of two presently preferred embodiment which are illustrated schematically in the accompanying drawings.

DESCRIPTION OF THE DRAWINS

Figure 6:
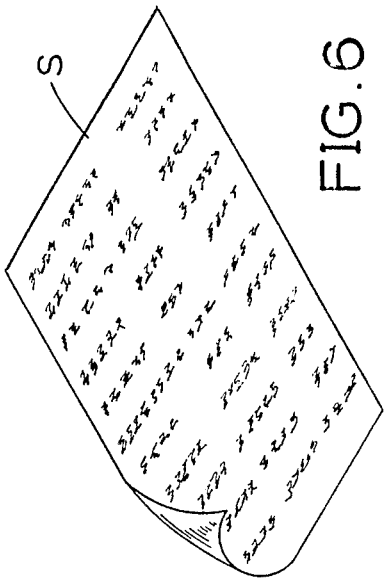
FIG. 6 is a perspective view showing a sheet of Milar with photographic images on one face which the apparatus removes.
Figure 4:
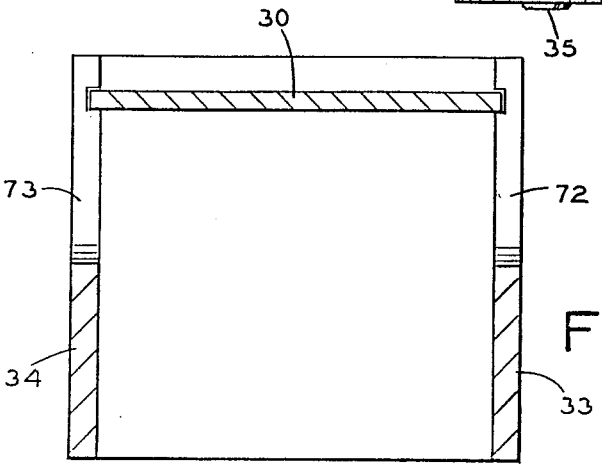
FIG. 4 is a cross-section taken along the line 4—4 in FIG. 3 at the inlet end of this apparatus.
Figure 10:
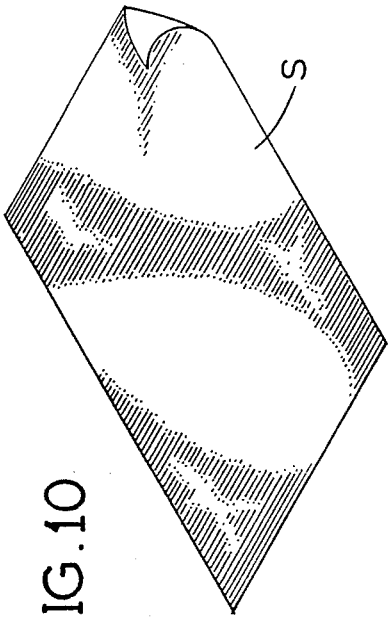
Figure 11:
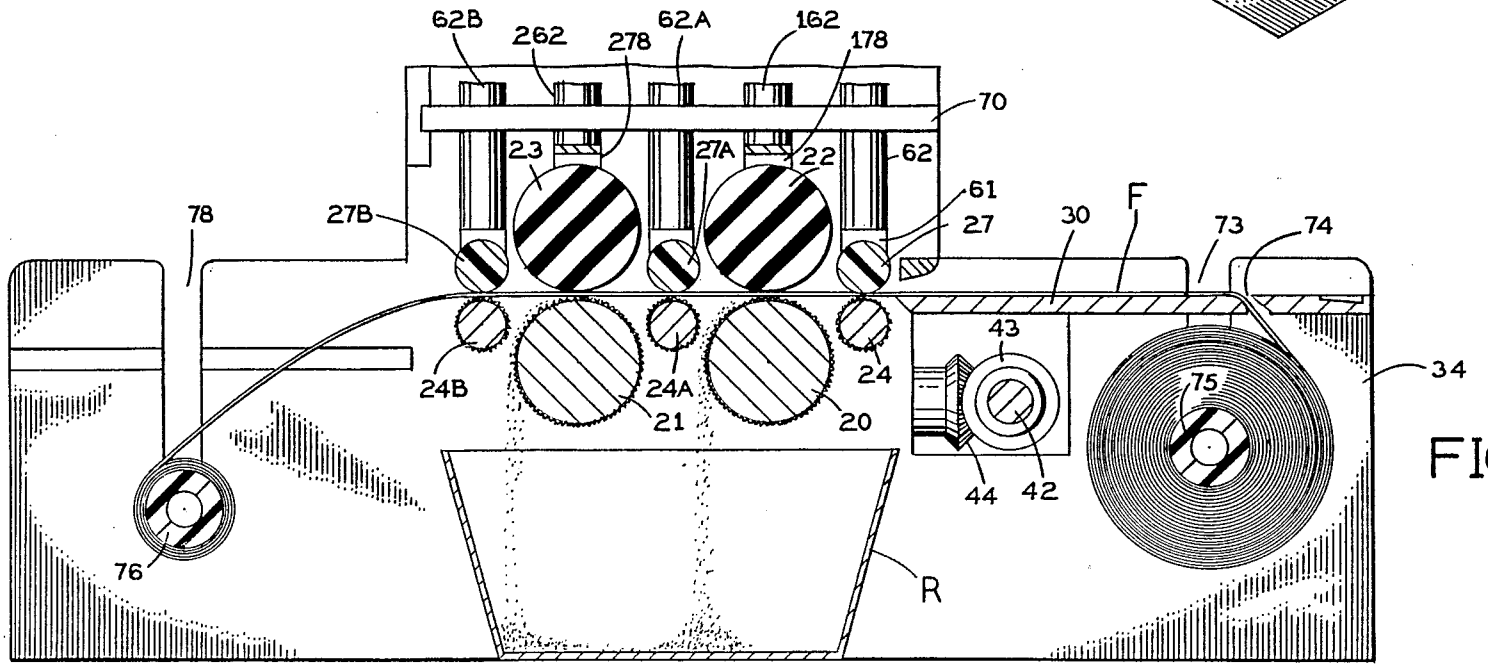
Figure 14:
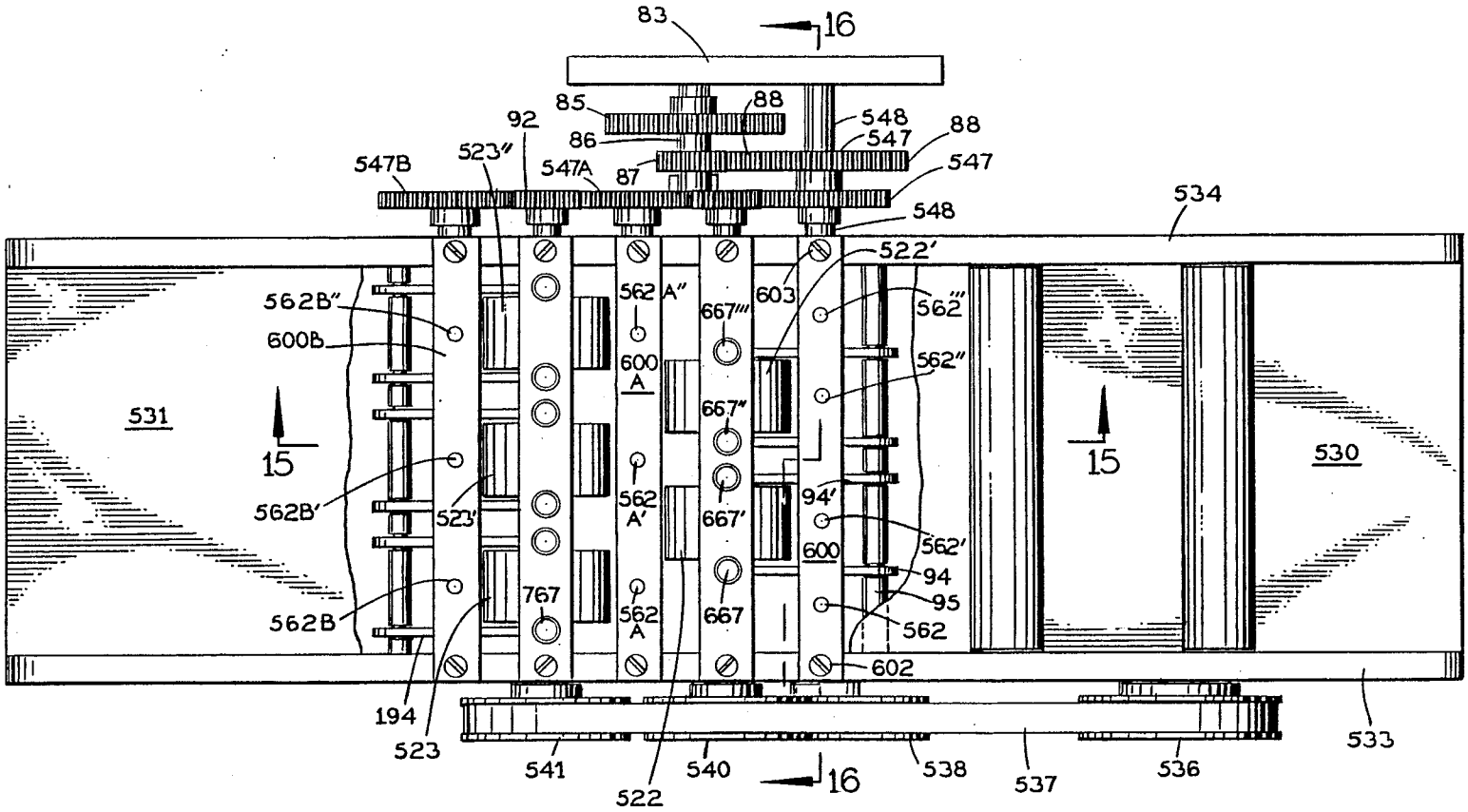
Figure 15:
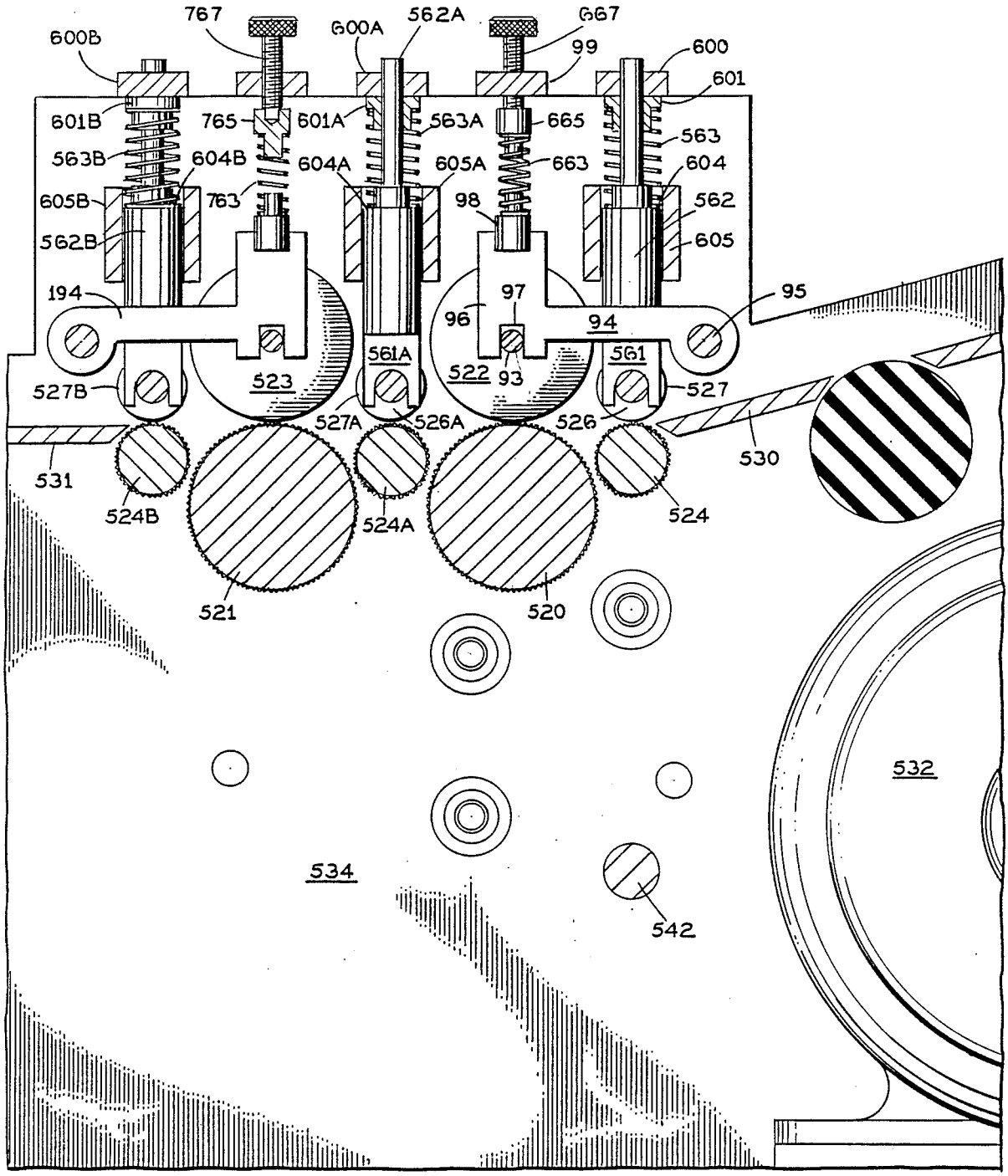
Figure 16:
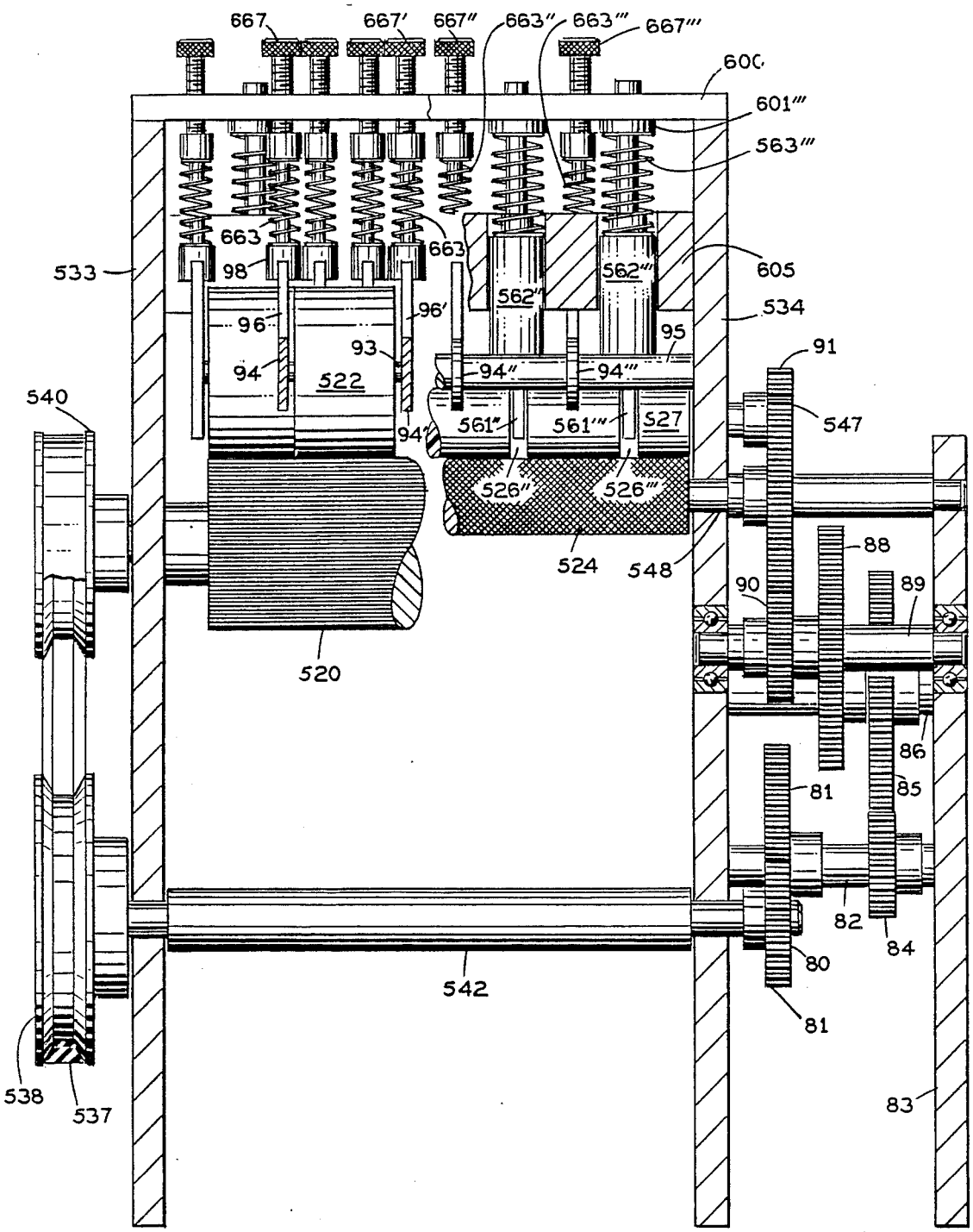

FIG. 10 view of the FIG. 6 sheet after the photographic images have been removed by the apparatus;

FIG. 11 is a longitudinal vertical section through the apparatus of FIG. 1–5 and 7–10 with a continuous roll or web of Mylar film passing through it for removal of photographic images from the bottom face;

FIG. 12 is a side elevation of a second embodiment of the present apparatus, with the front side partly broken away for clarity;

FIG. 13 is a similar view of the apparatus of FIG. 12 from the opposite side;

FIG. 14 is a top plan view of this apparatus with the top of its housing partly broken away to reveal working parts;

FIG. 15 is a partial longitudinal vertical section taken along the line 15—15 in FIG. 14; and FIG. 16 is a vertical cross-secition taken along the line 16—16 in FIG. 14.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Figure 3:
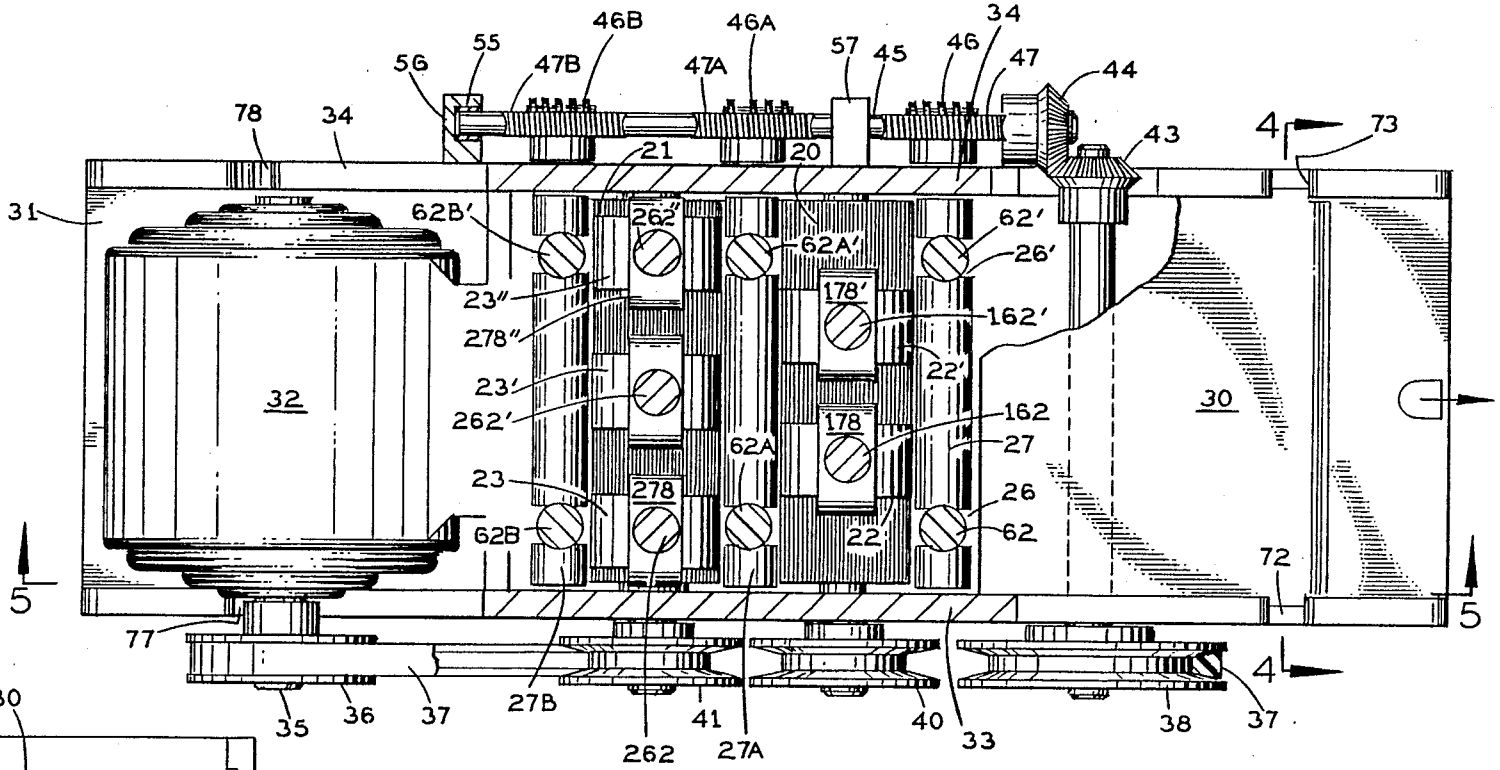
FIG. 3 is a view taken along the line 3—3 in FIG. 1, showing this apparatus partly in a top plan view and partly in longitudinal horizontal section.
Figure 5:
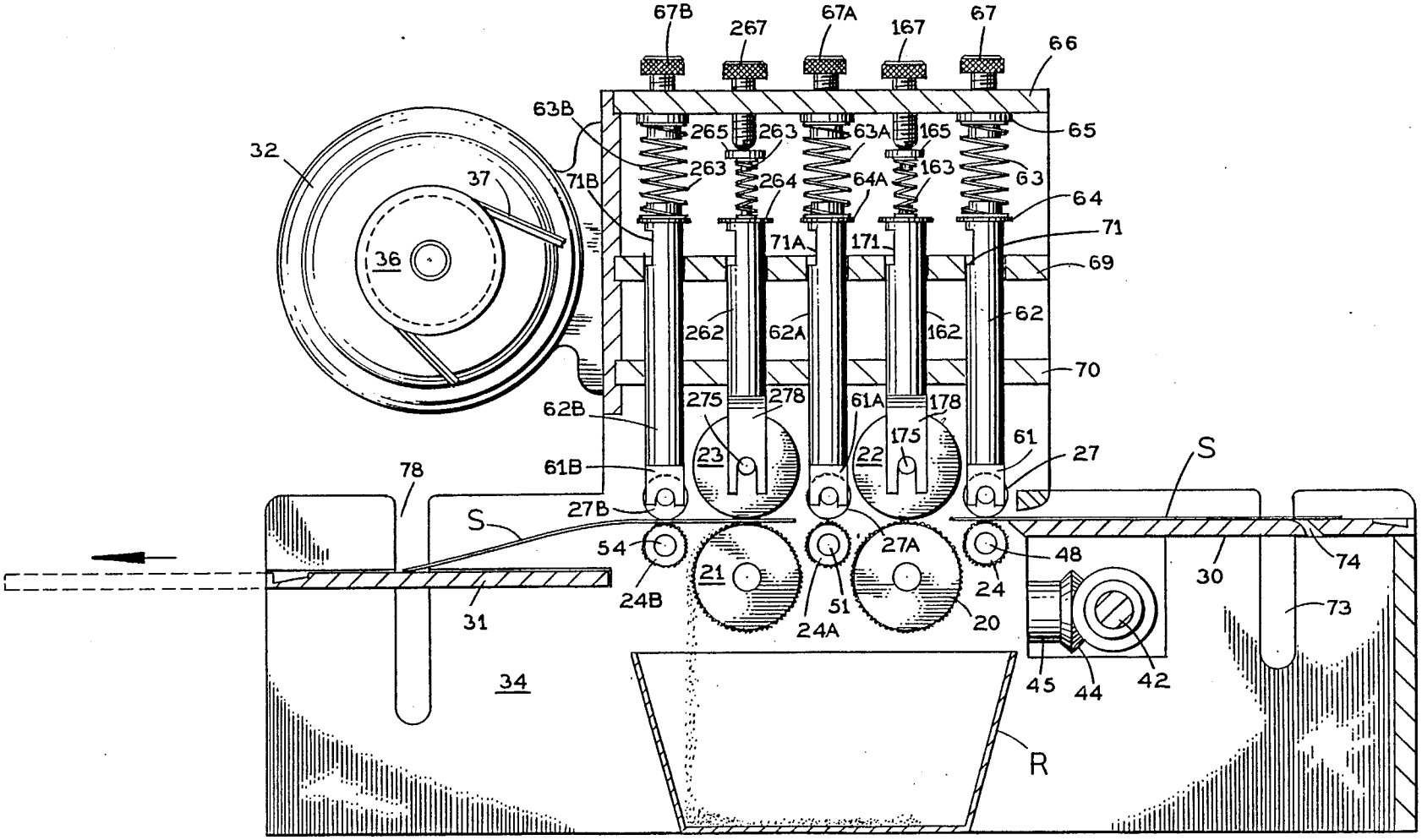
FIG. 5 is a longitudinal vertical section taken along the line 5—5 in FIG. 3.

Referring to FIGS. 3 and 5, in broad outline the first embodiment of the present invention comprises:

- first and second motor-driven abrading rollers 20 and 21 for scraping engagement from below with a sheet S of Mylar film with photographic images on its bottom face;
- two laterally spaced, spring-biased, pressure rollers 22 and 22' directly above the first abrading roller 20 for engaging the Mylar sheet S from above;
- three laterally-spaced, spring biased, pressure rollers 23, 23' and 23" directly above the second abrading roller 21 to engage the sheet S from above;
- first, second and third motor-driven feed rollers 24,24A and 24B in succession on opposite sides of the abrading rollers 20 and 21 for advancing the Mylar sheet S at a substantially lower velocity than the surface velocity of each abrading roller 20 and 21;
- spring-biased pressure rollers 27,27A and 27B directly above the feed rollers 24,24A and 24B, respectively;
- an inlet feed table 30 at the inlet side of the first feed roller 24 and its pressure roller 27;
- an outlet feed table 31 at the outlet side of the final feed roller 24B and its pressure roller 27B;
- and an electrica motor 32 for driving the feed rollers 24,24A and 24B at one surface velocity and driving the abranding rollers 20 and 21 at a substantially higher surface velocity.

Figure 1:
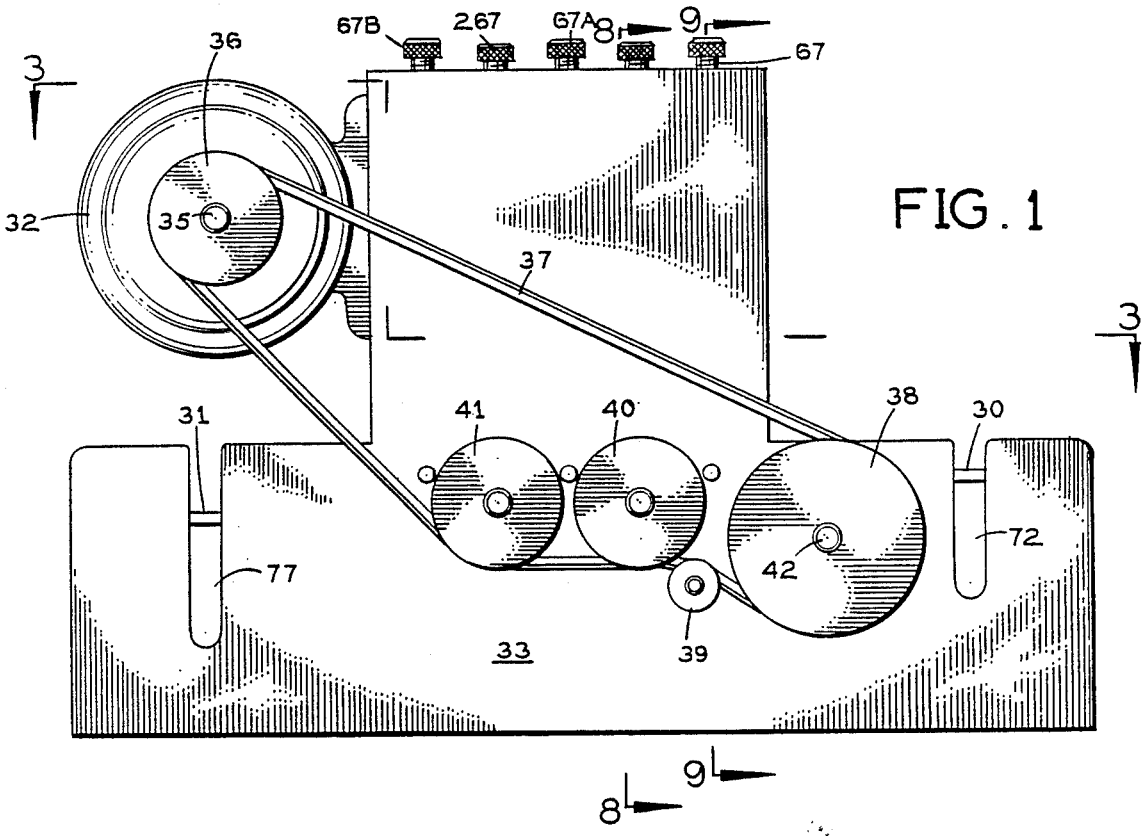
FIG. 1 is a side elevation of a first embodiment of the present apparatus.
Figure 2:
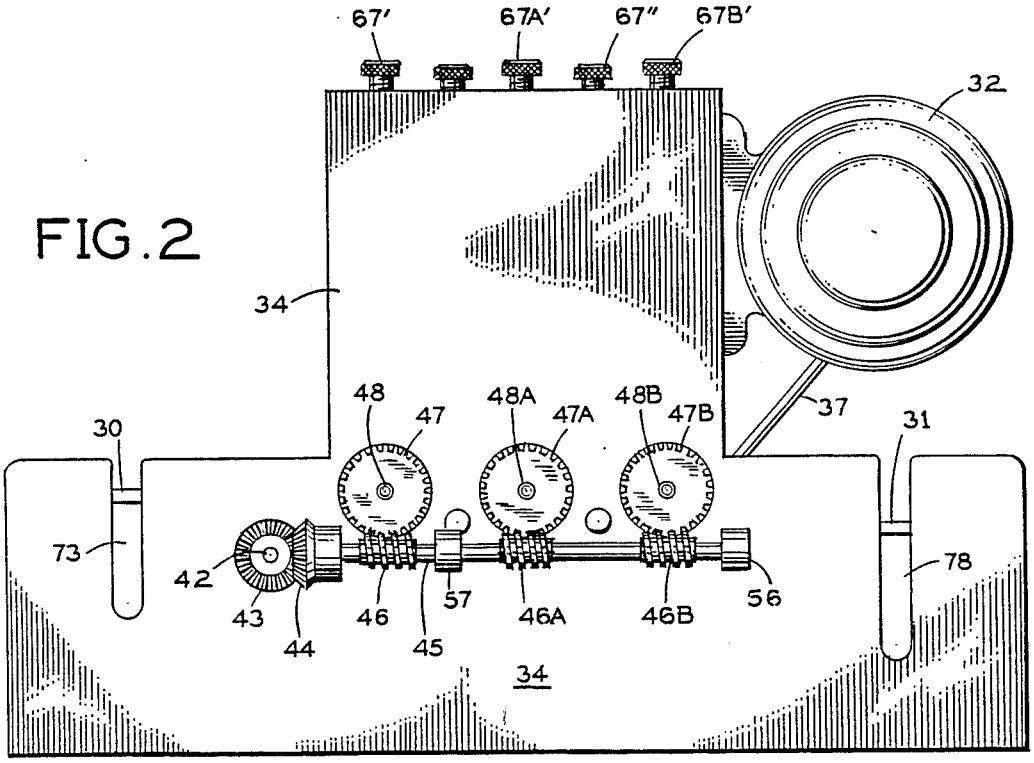
FIG. 2 is a similar view taken from the opposite side.

This embodiment of the present apparatus has a housing with opposite vertical side wall 33 and 34 (FIG. 3), each substantially in the shape of an inverted "T", as shown for the side wall 33 in FIG. 1 and for the other side wall 34 in FIG. 2. The electric motor 32 is rigidly supported by this housing and its rotary output shaft 35 carries a pulley 36 outside the side wall 33 of the housing. This motor pulley drives an andless flexible V-belt 37 (FIG. 1) which extends around an end pulley 38 and over a small idler pulley 39, which holds it up against a pulley 40 connected regidly to the first abrading roller 20 and up against a pulley 41 connected rigidly to the second abrading roller 21.

Figure 7:
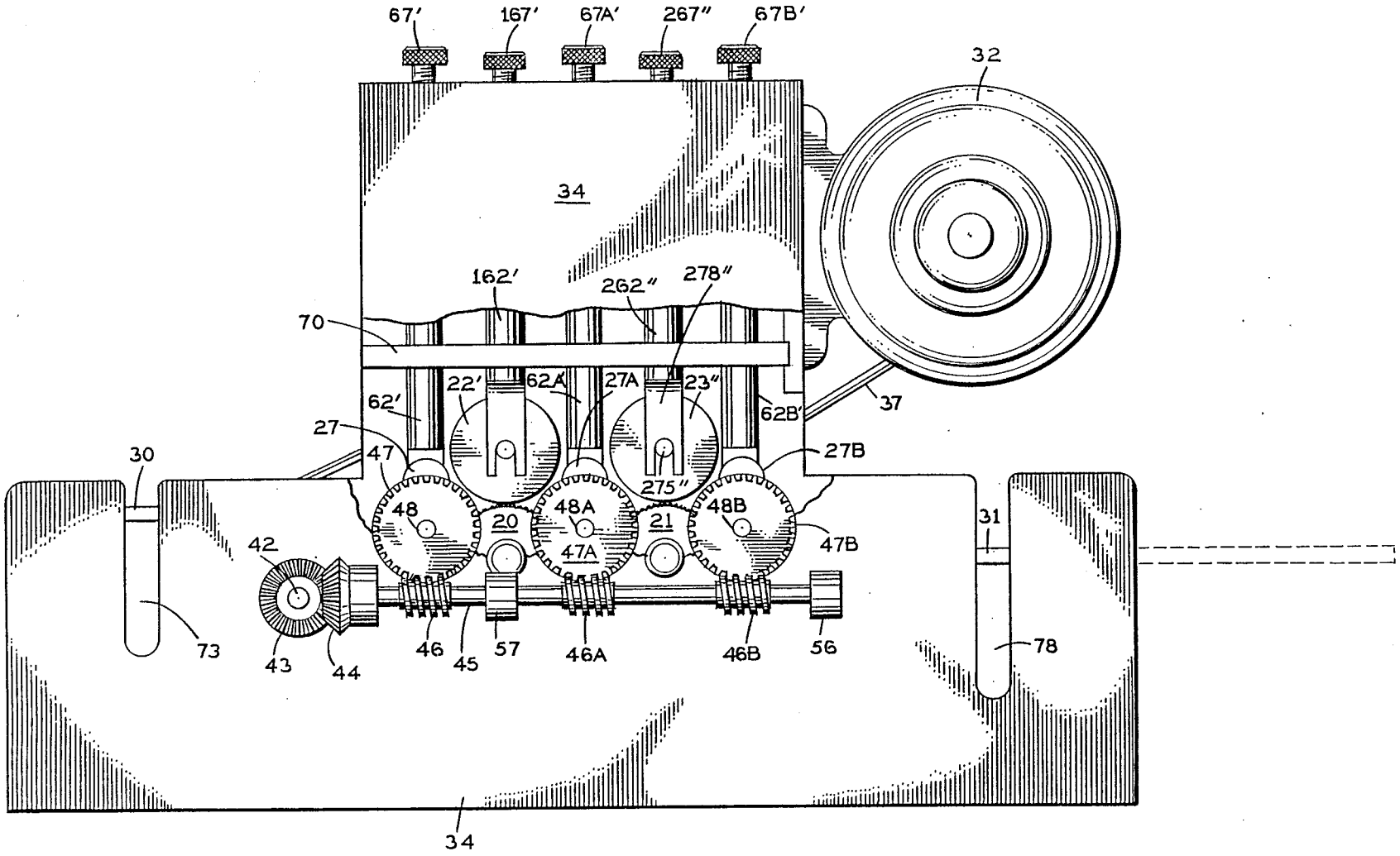
FIG. 7 is a view similar to FIG. 2 but with the housing of the apparatus partly broken away to reveal working parts.

As shown in FIG. 3, the end pulley 38 is attached to a rotatable horizontal shaft 42 that extends between and through the side walls 33 and 34 of the apparatus. At its end away from pulley 38, shaft 42 carries a bevel gear 43 which meshes with a bevel gear 44 on one end of a horizontal shaft 45 that extends outside the side wall 34 of the apparatus. As shown in FIG. 7, shaft 45 carries a first worm 46 that meshes with a gear 47 on a shaft 48 carrying the first feed roller 24 (FIG. 9), a second worm 46A that meshes with a gear 47A on a shaft 48A carrying the second feed roller 24A (FIG. 5), and a third worm 46B that meshes with a gear 47B on a shaft 48B carrying the third feed roller 24B. As shown in FIG. 3, the end of shaft 45 remote gear 44 is rotatably supported by an anti-friction bushing 55 in a block 56 on the outside of side wall 34. Between the first and second worms 46 and 46A, shaft 45 is rotatably supported by an anti-friction bushing (not shwon) in a block 57 on the outside of side wall 34.

Figure 9:
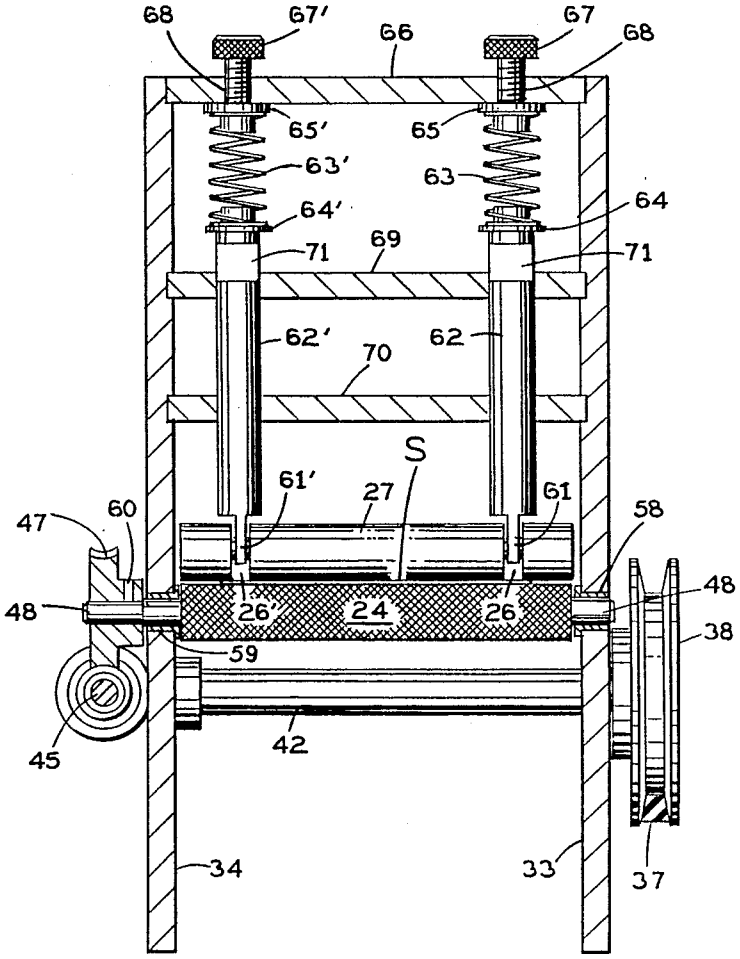
FIG. 9 is a vertical cross-section taken along the line 9—9 in FIG. 1.

As shown in FIG. 9, the first feed roller 24 extends horizontally across substantially the complete distance between the opposite side walls 33 and 34 of the housing. Its shaft 48 is rotatably supported by flanged anti-friction bushings 58 and 59 in side walls 33 and 34, respectively. Outside the side wall 34, gear 47 is attached to shaft 48 by a set screw 60.

The other two feed rollers 24A and 24B are similarly arranged.

The pressure roller 27 above the first feed roller 24 is of solid cylindrical cross-section for most of its length between the side walls 33 and 34. Roller 27 is cut away at 26 and 26' (FIGS. 3 and 9) to provide respective solid cylindrical segments of reduced cross-section.

The cut-away portion 26 of pressure roller 27 receives a yoke 61 (FIGS. 5 and 9) on the lower end of a vertical rod 62 which is biased downward by a coil spring 63. Spring 63 is engaged under compression between a transverse annular flange 64 on rod 62 near it upper end and a flanged end pieced 65 located just below a horizontal top wall 66 of the housing of the apparatus. An adjusting screw 67 is screw-threaddly received in an opening 68 (FIG. 9) in the top wall and its lower end engages the top of the flanged end piece 65. The downward force of spring 63 on pressure roller 27 can be adjusted by turning the adjusting screw 67. Rod 62 passes slidably down through openings in a pair of vertically-spaced horizontal walls 69 and 70 inside the housing below its top wall 66 and between its side walls 33 and 34. Adjacent the upper inside wall 69 the rod 62 is formed with a flat-bottomed recess 71 (FIG. 5) on one side.

The other cut-away portion 26' of pressure roller 27 receives a yoke 61' (FIG. 9) on the lower end of a vertical rod 62' having a spring-bias arrangement identical to the one just described for rod 62. Elements of this spring bias arrangement for rod 62' have the same reference numerals with a "prime" suffix added as those for rod 62, so the detailed description of these elements need not be repeated.

The pressure roller 27A above the second feed roller 24A and the pressure roller 27B above the third feed roller 24B have spring bias arrangements identical to the ones described for pressure roller 27. Elements of the spring bias arrangement for pressure roller 27A have the same reference numerals plus an "A" suffix as those for roller 27. Elements of the spring bias arrangement for pressure roller 27B have the same reference numerals plus a "B" suffix as those for roller 27. The detailed description of these elements need not be repeated.

Each of the feed rollers 24, 24A and 24B is a rigid metal roller with a diamond-knurled surface. Each of the pressure rollers 27,27A and 27B is of nylon or other relatively firm material. The adjusting screwa 67,67',67A, 67A',67B and 67B' for pressure rollers 27,27A and 27B are adjusted to provide enough downward force on them that they have a relatively high coefficient of friction on a Mylar sheet S engaged between them and the respective metal feed rollers 24,24A and 24B below. This insures that the Mylar sheet S is advanced through the apparatus at the surface speed of each feed roller 24,24A and 24B, preferably about 10 feet per minute, and there is substantially no slippage between the sheet and each roller pair 24—27, 24A—27A, and 24B—27B between which the sheet passes in succession.

Figure 8:
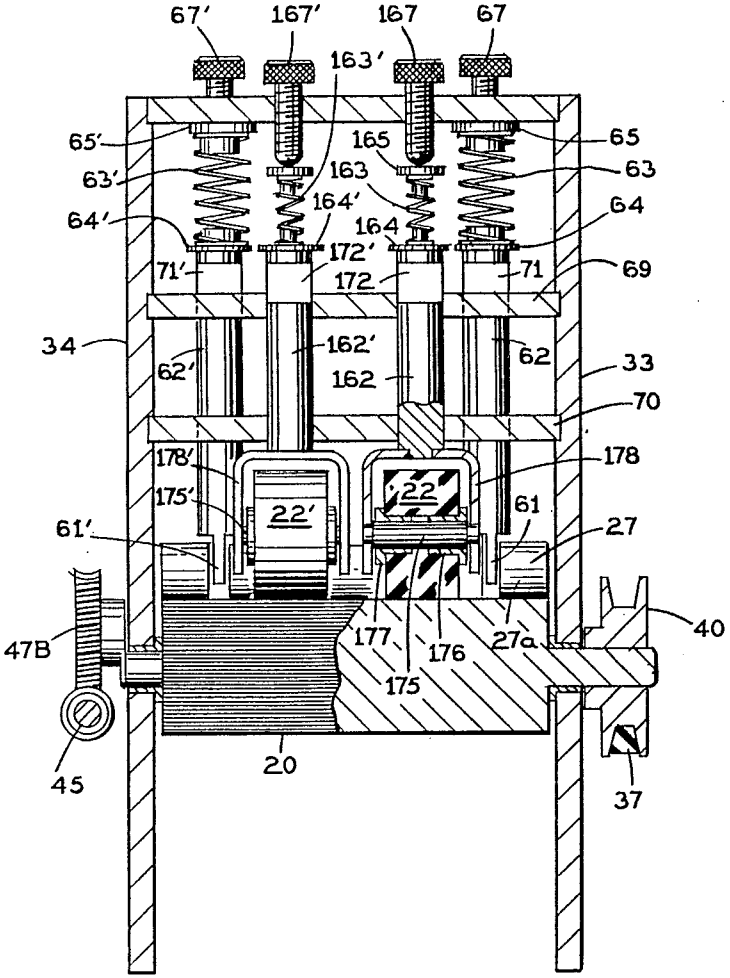
FIG. 8 is a vertical cross-section taken along the line 8—8 in FIG. 1.

As shown in FIG. 8, the two pressure rollers 22 and 22' above the first abrading roller 20 are spring biased down against it. Roller 22 is rotatably mounted on a horizontal cross-shaft 175 by a pair of flanged anti-friction bushings 176 and 177. Cross-shaft 175 is carried by a yoke 178. Yoke 178 is affixed to and extends down from a vertical rod 162, which except at its lower end is like the previously-described rod 62. Rod 162 is spring-biased downward by an arrangement substantially identical to the one described for rod 62. Elements of the biasing arrangement for rod 162 which correspond to the elements associated with rod 62 are given the same reference numerals plus 100 and these elements need not be described in detail.

The other pressure roller 22' above the first abrading roller 20 has a support and biasing arrangement identical to the one for roller 22. Element of this arrangement for roller 22' which correspond to those for roller 22 are given the same reference numerals with a "prime" suffix added.

The first abrading roller 20 is a metal with a metalized surface having abrasive properties. The pressure rollers 22 and 22' are of soft rubber, polyurethane foam or other suitable relatively soft, deformable and resilient material. The adjustin acrews 167 and 167' are adjusted to provide only a relatively light downward spring force on pressure rollers 22 and 22' so as to permit slippage between the Mylar sheet S and rollers 20,22 and 22'. Preferably, the first abrading roller 20 has a surface velocity of about 800 feet per minute whereas the sheet S is moving tangentially past roller 20 at about 10 feet per minute.

The second abrading roller 21 is identical to roller 20 and it is driven at the same speed.

Three laterally offset pressure rollers 23,23' and 23" (FIG. 3) overlie the second abranding roller at locations offset from the locations of the pressure rollers 22 and 22' for the first abrading rollers 20. Each pressure roller 23,23' and 23" has a support and spring-bias arrangement like that for the pressure roller 22, as described in detail, and has the same reference numerals as those for roller 22 but in a "200" series instead of a "100" series.

The adjusting screws for pressure rollers 23,23' and 23" are adjusted so that there is only a relatively light spring force downward on each of them, permitting slippage between the Mular sheet S and rollers 21,23,23' and 23".

Referring to FIG. 5, a microfiche or other Mylar sheet S with photographic images on one face is placed on the inlet table 30 with the photographic image face down and is slid between the first feed roller 24 and the spring-biased pressure roller 27 above. These rollers pull the sheet S between them at the speed at which feed roller 24 is being driven by motor 32 and they push it between the much faster moving first abrading roller 20 and the two pressure rollers 22 and 22' above it. The first abrading roller 20 scrapes off the photographic images on the two laterally spaced, longitudinal segments of sheet S that pass beneath pressure rollers 22 and 22'. Because the abrading roller 20 is moving tangentially past the sheet S at a much higher speed than the sheet itself is being advanced, each longitudinal increment of the sheet during its passage between abrading roller 20 and either pressure roller 22 or 22' is scraped by a great number of ridges on the surface of the abrading roller. This insures complete removal of the photographic images in these segments of the sheet. Small discrete particles are scraped from the sheet and drop into a receptacle R below (FIG. 5).

After passing over the first abrading roller 20 the sheet S passes between the second feed roller 24A and the pressure roller 27A above it, which pull it forward at the same speed.

Then the sheet S passes between the second abrading roller 21 and the three pressure rollers 23,23' and 23" above it. The second abrading roller 21 scrapes off the photographic images on the three remaining laterally spaced, longitudinal segments of the sheet S that pass beneath pressure rollers 23,23' and 23". The second abrading roller 21 is being driven by motor 32 at a much higher surface speed than the speed at which the sheet S is moving and this insures the total removal of the photographic images from these remaining segments of the sheet.

After passing over the second abrading roller 21, the sheet S passes between the third feed roller 24B and the pressure roller 27B above it, which pull it forward at the same speed and deposit is on the table 31 at the outlet end of the apparatus.

FIG. 11 shows how just-described apparatus may be used to remove photographic images from a continuous roll of web of film F.

One side wall 33 of the housing of the apparatus has a vertical slot 72 (FIG. 1) and the opposite side wall 34 has an aligned vertical slot 73 (FIG. 2), each slot being open at the top and located a short distance in front of an inclined opening 74 (FIG. 5) in table 30 at the inlet side of the apparatus. As shown in FIG. 11, a roll R of photographic film on a spool 75 has the ends of the spool slidably received in slots 72 and 73 in the side walls 33 and 34 of the housing, and the film passes up thruogh the table opening 74 onto the table 30.

At the opposite end of the apparatus, the table 31 has been removed and a takeup spool 76 for the film is dropped down into vertical slots 77 and 78 in the opposite side walls 33 and 34 of the housing. Slots 77 and 78 are shown separately in FIG. 1 and 2.

Where the Mylar sheet is a continuous web from a roll, a single abrading roller 20 or 21 is sufficient and the other abrading roller may be omitted, along with its pressure rollers and one feed roller and its pressure roller. In such a modified arrangement the pressure rollers or roller overlying the single abrading roller would cover the full width of the web where photographic images are located. The omission of one abrading roller from the machine is possible because while the web is being scraped by the abrading roller it is also being gripped by the feed rollers and their pressure rollers on opposite sides (i.e., the inlet and outlet sides) of the abrading roller with sufficient force that they determine the speed of the web. Thus, the length of the sheet S when it is a web from a roll enables this simplification of the present invention.

From the foregoing detailed description and the accompanying drawings it will be evident that the present invention achieves the complete destruction of the photographic images on a film by scraping the face of the film to remove small film particles that include all the discrete elements of the photographic image. An unauthorized person cannot reassemble all these particles to recompose the photographic image or any significant part of it.

However, when the Mylar sheet is a microfiche that is not long enough to be engaged simultaneously by the feed rollers on opposite sides of an abrading roller throughout its movement past the abrading roller, experience has shown that two abrading rollers are necessary because each abrading roller tends to grab the microfiche and pull it through at a higher speed than the surface velocity of the feed rollers. Consequently, two abrading rollers are necessary to insure the complete removal of photographic images from the microfiche in all cases.

FIGS. 12–16 show a presently preferred second embodiment of the invention which is generally similar to the first embodiment but differs from it in its roller drive arrangement and the spring-biasing of its pressure rollers.

Referring to FIGS. 15 and 16, in broad outline the second embodiment of the present abrading apparatus comprises:

- first and second motor-driven abrading rollers 520 and 521 (FIG. 15) for scraping engagement from below with a sheet S of Mylar film (either a microfiche or a continuous web) with photographic images on its bottom face;
- two laterally spaced, spring-biased, pressure rollers 522 and 522' (FIG. 14) directly above the first abrading roller 520 for engaging the Mylar sheet S from above;
- three laterally spaced, spring-biased, pressure rollers 523,523' and 523" directly above the second abrading roller 521 to engage the sheet S from above;
- first, second and third motor-driven feed rollers 524,524A and 524B (FIG. 15) in succession on opposite sides of the abrading rollers 520 and 521 for advancing the Mylar sheet S at a substantially lower velocity than the surface velocity of each abrading roller 520 and 521;
- spring-baised pressure rollers 527,527A and 527B directly above the feed rollers 524,524A and 524B, respectively;
- a forwardly and downwardly inclined feed table 530 at the inlet side of the first feed roller 524 and its pressure roller 527;

a horizontal outlet feed table 531 at the outlet side of the final feed roller 524B and its pressure roller 527B;

and an electric motor 532 for driving the feed rollers 524,524A and 524B at one surface velocity and driving the abrading roller 520 and 521 at a substantially higher surface velocity.

The abrading apparatus has a housing with opposite vertical side walls 533 and 534 (FIGS. 14 and 16), each substantially in the shape of an inverted "T", as shown for the side wall 533 in FIG. 12 and for the opposite side wall 534 in FIG. 13. The motor 532 is located below the inlet feed table 530 and its rotary output shaft 535 carries a pulley 536 outside the side wall 533 of the housing. This motor pulley drives an endless flexible V-belt 537 (FIG. 12) which extends in sucession across a pulley 540 connected rigidly to the first abrading roller 520, a pulley 541 connected rigidly to the second abrading roller 521, and a pulley 538. As shown in FIG. 16, pulley 538 is attached to a rotatable horizontal shaft 542 that extends between and through the side walls 533 and 534 of the apparatus. Outside the side wall 534, shaft 542 carries a drive gear 80 which meshes with a larger diameter gear 81 (FIG. 13) on a horizontal first idler shaft 82, which is rotatably supported by anti-friction bearings (not shown) in the housing side wall 534 and a vertical wall 83 (FIG. 16) on the opposite side of wall 534 from the other housing side wall 533. Idler shaft 82 carries a gear 84 of smaller diameter than its gear 81 which meshes with a larger diameter gear 85 on a horizontal second idler shaft 86 spaced vertically above the first idler shaft 82. Shaft 86 carries a smaller diameter gear 87 (FIG. 14) that meshes with a larger diameter gear 88 on a horizontal third idler shaft 89. Shaft 89 carries a smaller diameter gear 90 that meshes with a larger diameter gear 547 on a shaft 548 carrying the first feed roller 524.

Gear 547 drives a similar gear 547A (FIG. 13) through an idler gear 91. Gear 547A is on a shaft 548A which carries the second feed roller 524A.

Gear 547A drives a similar gear 547B through an idler gear 92. Gear 547B is on a shaft 548B carrying the third feed roller 524B.

With this arrangement, the three feed rollers 524,524A and 524B are are driven at the same speed from motor 532.

The pressure roller 527 above the first feed roller 524 is of solid cylindrical cross-section for most of its length between the side walls 533 and 534 of the apparatus. Roller 527 is cut away at four evenly spaced locations along its length, one of which is shown at 526 in FIG. 15 and a different pair of which are shown at 526'' and 526''' in FIG. 16. Roller 527 is of reduced solid cylindrical cross-section at these cut-away segments.

Referring to FIG. 15, the cut-away segment 526 of pressure roller 527 closest to side wall 533 receives a yoke 561 on the lower end of a vertical plunger 562 which is biased downward by a coil spring 563. Plunger 562 has reduced upper end segment that extends slidably up through a horizontal cross-piece 600 on the top of the housing of the apparatus and a flanged bushing 601 below this cross-piece. The cross-piece 601 is attached to the side walls 533 ad 534 of the housing at the top by screw 602 and 603 (FIG. 14). Spring 563 is under compression between bushing 601 and an upwardly facing, annular shoulder 604 on plunger 562. The larger diameter lower segment of plunger 562 is slidably received in a cylindrical vertical opening in a lower cross-piece 605 extending from side-to-side horizontal across the inside of the housing of the apparatus.

Identical spring-biased plungers 562',562'' and 562''' engage the pressure roller 527 from above at its cut-away segments 526',526'' and 526''', respectively. The upper ends of these plungers appear in FIG. 14, and plungers 562'' and 562''' are shown in detail in FIG. 16.

The four spring-biased plungers 562,562',562'' and 562''' exert a downward force on pressure roller 527 so that the Mylar sheet passing tangentially between this pressure roller and the first drive roller 524 beneath it is advanced at the same surface speed as that of drive roller 524, preferably about 10 feet per minute.

The pressure roller 527A above the second drive roller 524A is biased downward in the same fashion by three spring-pressed plungers 562A,562A' and 562A'' at equal intervals along its length, as shown in FIG. 14. As shown in FIG. 15 for the plunger 562A closest to the side wall 533 of the apparatus, a yoke 561A on the lower end of this plunger straddles the reduced segment 526A of pressure roller 527A. A coil spring 563A is engaged under compression between an upwardly-facing shoulder 604A on this plunger and a flanged bushing 601A beneath a cross-piece 600A at the top of the housing.

These three plungers are guided by a corresponding lower cross-piece 605A inside the housing, which has cylindrical vertical openings for slidably receiving the plungers.

Similarly, the pressure roller 527B above the third drive roller 524B is biased downward by three spring-pressed plungers 562B,562B' and 562B'' (FIG. 14). The plunger 562B closest to the housing side wall 533 is shown in detail in FIG. 15. The other two are identical to it.

The three pressure rollers 527,527A and 527B cause the Mylar sheet S to be advanced by the corresponding drive rollers 524,524A and 524B without slippage with respect to these drive rollers, so that the linear velocity of the sheet S is the same as the surface velocity of each drive roller.

One of the pressure rollers 522 for the first abrading roller 520 is spring-biased downward by an arrangement shown in detail in FIG. 15 and 16. Pressure roller 522 is on a horizontal shaft 93 whose oppossite ends are engaged by respective pivoted levers 94 and 94', both pivoted on a horizontal cross shaft 95 (FIG. 15), which extends between the housing side wall 533 and 534 and is supported by them.

As shown for lever 94 in FIG. 15, at its end away from its pivoted support the lever presents an enlarged head 96 with a rectangular slot or recess 97 on the bottom which snugly receives the shaft 93 of pressure roller 522 so that this end of the lever straddles the roller shaft. A coil spring 663 is engaged under compression between a flanged insert 98 on the top of the enlarged head 96 at the free end of lever 94 and a similar member 665 which is engaged from above by an adjusting screw 667.

This adjusting screw 667 is threadedly received in a cross-piece 99 extending across the top of the housing of the apparatus. The adjusting screw 667 can be turned in either direction to either increase or decrease the downward exerted by spring 663 on the pressure roller 522.

The other pivoted lever 94' at the opposite end of roller 522 has an identical construction and an identical adjustable spring bias arrangment. In FIG. 16, the elements of this lever and its spring bias arrangment are given the same reference numerals, with a "prime" suffix added, as those for lever 94.

The second pressure roller 522 for the first abrading roller 520 is spring-biased downward in the same fashion by lever 94'' and 94''' at its opposites ends (FIG. 16) which are acted on by respective springs 663'' and 663''', the force of which is selectively adjustable by respective adjusting screws 667''and 667'''.

The three pressure rollers 523,523' and 523'' for the second abrading roller 521 are spring-biased downward by respective pairs of levers, springs and adjusting screws identical to those just described for pressure rollers 522 and 522', except that the levers for pressure rollers 523,523' and 523'' are reversed end-to-end from the positions of those for pressure rollers 522 and 522'.

FIG. 15 shows one lever 194 of the pair associated with pressure roller 523 and the corresponding spring 763 and adjusting screw 767. It will be understood that the lever, spring and adjusting screw at the opposite end of roller 523 are identical to the ones shwon in FIG. 15, and this is also true of both levers, springs and adjusting screws for each pressure roller 523' and 523''.

The operation of this second embodiment of the invention is essentially the same as that of the first embodiment, already described in detail.

From the foregoing description and the accompanying drawings, it will be evident that the disclosed embodiments of the invention achieve its stated purpose of removing all the photographic images on a Mylar sheet, whether a microfiche or a continuous roll, and reducing them to particles so small and so numerous that the images cannot be reconstructed.

I claim:

1. A photographic image removal apparatus for use with a photographic film member having photographic images on one face thereof, said apparatus comprising:

abrading roller means mounted for rotation;

means for advacing the film member tangentially past said abrading roller means at a predetermined speed along a predetermined path;

pressure roller means resiliently engaging the oppositive face of said film member and biasing said film member against said abrading roller means for scraping engagement of said abrading roller means against said one face of the film member;

and means for rotating said abrading roller means at a surface velocity several times said predetermined speed of said film member;

said abrading roller means comprising first and second abrading rollers spaced apart along said path of said film member and each having surface discontinuities thereon for scraping photographic images from said film member;

and said pressure roller means comprising a first set of pressure rollers located directly opposite said first abrading roller and a second set of pressure rollers located directly opposite said second abrading roller;

the pressure rollers of said first set being spaced apart axially along said first abrading roller to hold corresponding segments of the film member resiliently against said first abrading roller;

the pressure rollers of said set being spaced apart axially along said second abrading roller at remaining segments of the film member to hold said remaining segments of the film member resiliently against said second abrading roller.

2. An apparatus according to claim 1 wherein said means for advancing the film member comprises:

a first feed roller located along said path before said first abrading roller and said first set of pressure rollers;

a second feed roller located along said path after said first abrading roller and said first set of pressure rollers and before said second abrading roller and said second set of pressure rollers;

a third feed roller located along said path after said second abrading roller and said second set of pressure rollers; each of said feed rollers having surface discontinuities thereon and being positioned for tangential engagement by one of said opposite faces of the film member;

means for rotating said feed rollers at a surface speed which is only a fraction of the surface speed of said first and second abrading rollers;

pressure rollers respectively located directly opposite said feed rollers to hold said film member against said feed rollers; and spring means biasing said last-mentioned pressure rollers toward the respective feed rollers to hold the film member against the feed rollers with sufficient force to substantially prevent slippage between the film member and the feed rollers.

3. An apparatus according to claim 2 wherein said feed rollers engage said face of said film member which has the photographic images thereon.

4. An apparatus according to claim 3 wherein said feed rollers and the corresponding pressure rollers engage said film member between them across its complete width.

5. An apparatus according to claim 4 and further comprising:

means for selectively adjusting individually the respective forces of the pressure rollers of said first set biasing said film member against said first abrading roller;

and means for selectively adjusting individually the respective forces of the pressure rollers of said second set biasing said film member against said second abrading roller.

6. An apparatus according to claim 5 and further comprising means fr selectively adjusting individually the respective biasing forces on said film member of said pressure rollers located directly opposite said feed rollers.

7. An apparatus according to claim 2 wherein said feed rollers and the corresponding pressure rollers engage said film member between them across its complete width.

8. An apparatus according to claim 1 wherein each of said pressure rollers of said first and second sets is of relatively soft, deformable and resilient material.

9. An apparatus according to claim 4 wherein said pressure rollers located directly opposite said first and second abranding rollers are each of soft, deformable and resilient material.

10. A photographic image removal apparatus for use with a photographic film member having photographic images on one face thereof, said apparatus comprising:

abrading roller means mounted for rotation;

means for advacing the film member tangentially past said abrading roller means at a predetermined speed along a predetermined path;

pressure roller means resiliently engaging the opposite face of said film member and biasing said film member against said abrading roller means for scraping engagement of said abrading roller means against said one face of the film member;

and means for rotating said abrading roller means at a surface velocity several times said predetermined speed of said film member; said means for advancing the film member comprising feed rollers respectively located along said path before and after said abrading roller means;

each of said feed rollers having surface discontinuities thereon and being tangentially engaged by one of said oppasite faces of the film member;

means for rotating said feed rollers at a surface speed which is only a fraction of the surface speed of said abrading roller means;

pressure rollers respectively located directly opposite said feed rollers to hold said film member against said feed rollers;

and spring means biasing said last-mentioned pressure rollers toward the respective feed rollers to hold the film member against the feed rollers with sufficient force to substantially prevent slippage between the film member and the feed rollers.

11. An apparatus according to claim 10 wherein said feed rollers engage said face of said film member which has the photographic images thereon.

12. An apparatus according to claim 11 wherein said feed rollers and the corresponing pressure rollers engage said film member between them across its complete width.

13. An apparatus according to claim 12 wherein:

said pressure rollers means biasing said film member against said abrading roller means is of relatively soft, deformable and resilient material;

and said pressure rollers located directly opposite said feed rollers are of hard material.

14. An apparatus according to claim 10 wherein said feed rollers and the corresponding pressure rollers engage said film member between them across its complete width.

15. An apparatus for removing photographic images from one face of a Mylar film member comprising:

first, second and third feed rollers spaced apart from each other along a predetermined path and each having surface discontinuities thereon for engaging said one face of said film member;

corresponding pressure rollers of hard material respectively positioned directly opposite said feed rollers for engaging the opposite face of said film member;

means for rotating said feed rollers at a predetermined surface speed;

spring means biasing said pressure rollers toward said feed rollers and holding the film member against the feed rollers with sufficient force to prevent slippage between the film member and the feed rollers;

said feed rollers and the corresponding pressure rollers engaging said film member across its complete width perpendicular to said path;

a first abrading roller positioned along said path between said first and second feed rollers, said first abrading roller having a generally cylindrical surface with discontinuities thereon positioned to be tangentially engaged by said one face of the film member moving along said path;

a first set of deformable and resilient pressure rollers located directly opposite said first abrading roller for tangential engagement by said opposite face of said film member, the pressure rollers of said first set being spaced apart axially along said first abrading roller to hold corresponding segments of the film member against said first abrading roller;

spring means biasing said first set of pressure rollers toward said first abrading roller to yieldingly hold said first set of pressure roller against said film member;

a second abrading roller positioned along said path between said second and third feed rollers, said second abrading roller having a generally cylindrical surface with discontinuities thereon positioned to be tangentially engaged by said one face of the film member moving along said path;

a second set of deformable and resilient pressure rollers located directly opposite said second abrading roller for tangential engagement by said opposite face of said film member, the pressure rollers of said second set being spaced apart axially along said second abrading roller at remaining segments of the film member to hold said remaining segments of the film member against said second abrading roller;

spring means biasing said second set of pressure rollers toward said second abrading roller to yieldingly hold said second set of pressure rollers against said film member;

and means for rotating said first and second abrading rollers at a surface speed several times said surface speed of said feed rollers.

16. An apparatus according to claim 15 wherein the pressure rollers of said first and second sets are of soft rubber-like material.

17. An apparatus according to claim 16 wherein said pressure rollers positioned opposite said feed rollers are of nylon.

18. An apparatus according to claim 17, wherein said first set of pressure rollers consists of two rollers, and said second set of pressure rollers consists of three rollers.

19. An apparatus according to claim 16 and further comprising:

means for selectively adjusting individually the respective forces of the pressure rollers of said first set against said film member;

and means for selectively adjusting individually the respective forces of the pressure rollers of said second set against said film member.

20. An apparatus according to claim 19 and further comprising:

means for selectively adjusting individually the respective forces of said corresponding pressure rollers for holding the film member against said first, second and third feed rollers.

* * * * *